US006565390B2

(12) United States Patent
Wu

(10) Patent No.: US 6,565,390 B2
(45) Date of Patent: May 20, 2003

(54) POLARIZING SYSTEM RECEIVING COMPATIBLE POLARIZING SYSTEM FOR BLIND MATE CONNECTOR ASSEMBLY

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 44 days.

(21) Appl. No.: 10/029,789

(22) Filed: Oct. 22, 2001

(65) Prior Publication Data

US 2003/0077946 A1 Apr. 24, 2003

(51) Int. Cl.[7] ..... H01R 13/64
(52) U.S. Cl. ..... 439/680; 439/378; 439/677
(58) Field of Search ..... 439/680, 681, 439/378, 674, 677

(56) References Cited

U.S. PATENT DOCUMENTS 5,356,300 A * 10/1994 Costello et al. ..... 439/101
5,466,171 A * 11/1995 Bixler et al. ..... 439/378
5,830,001 A * 11/1998 Kinoshita et al. ..... 439/354
5,885,088 A * 3/1999 Brennan et al. ..... 439/680
6,315,606 B1 * 11/2001 Hwang ..... 439/557

* cited by examiner

*Primary Examiner*—Tho D. Ta
*Assistant Examiner*—James R. Harvey
(74) *Attorney, Agent, or Firm*—Wei Te Chung

(57) ABSTRACT

A polarizing system for electrical connector assembly includes first and second connectors mateable with each other. The polarizing system comprises a pair of polarizing posts projecting on both ends of the first housing. The polarizing posts are arranged generally along a longitudinal axis of the first housing and with one of the posts being different from the other post. An elongate polarizing receptacle extends longitudinally along the second connector with a first end dimensioned to receive the first post and a second end dimensioned to receive the second post.

5 Claims, 4 Drawing Sheets

POLARIZING SYSTEM RECEIVING COMPATIBLE POLARIZING SYSTEM FOR BLIND MATE CONNECTOR ASSEMBLY

FIELD OF THE INVENTION

The present invention relates to a polarizing system, and more particular to polarizing system used in an electrical connector assembly and which receives other compatible polarizing system.

DESCRIPTION OF THE PRIOR ART

Having a polarizing system in an electrical connector assembly is essential to ensure correct mating between male and female connectors. However, each connector maker has their unique polarizing system which preclude other connector from mating thereto. As a result, the system integrator can only purchase the connectors from a single source which will inevitable increase the cost.

U.S. Pat. No. 5,466,171 issued to Bixler provides a polarizing system which can effectively prevent incorrect mating between male and female connectors. In addition, it further provides structure to facilitate blind mate between two printed circuit boards. Because the polarizing posts are completely surrounded by the corresponding polarizing receptacles, it precludes other male or female connector of other connector makers from mating thereto. As a result, the system integrator has no other choice but purchasing from the single source.

SUMMARY OF THE INVENTION

It is an object of this invention to provide a polarizing system which accepts other compatible polarizing system.

In order to achieve the objective set forth, a polarizing system for electrical connector assembly in accordance with the present invention includes first and second connectors mateable with each other. The polarizing system comprises a pair of polarizing posts projecting on both ends of the first housing. The polarizing posts are arranged generally along a longitudinal axis of the first housing and with one of the posts being different from the other post. An elongate polarizing receptacle extends longitudinally along the second connector with a first end dimensioned to receive the first post and a second end dimensioned to receive the second post.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 1:
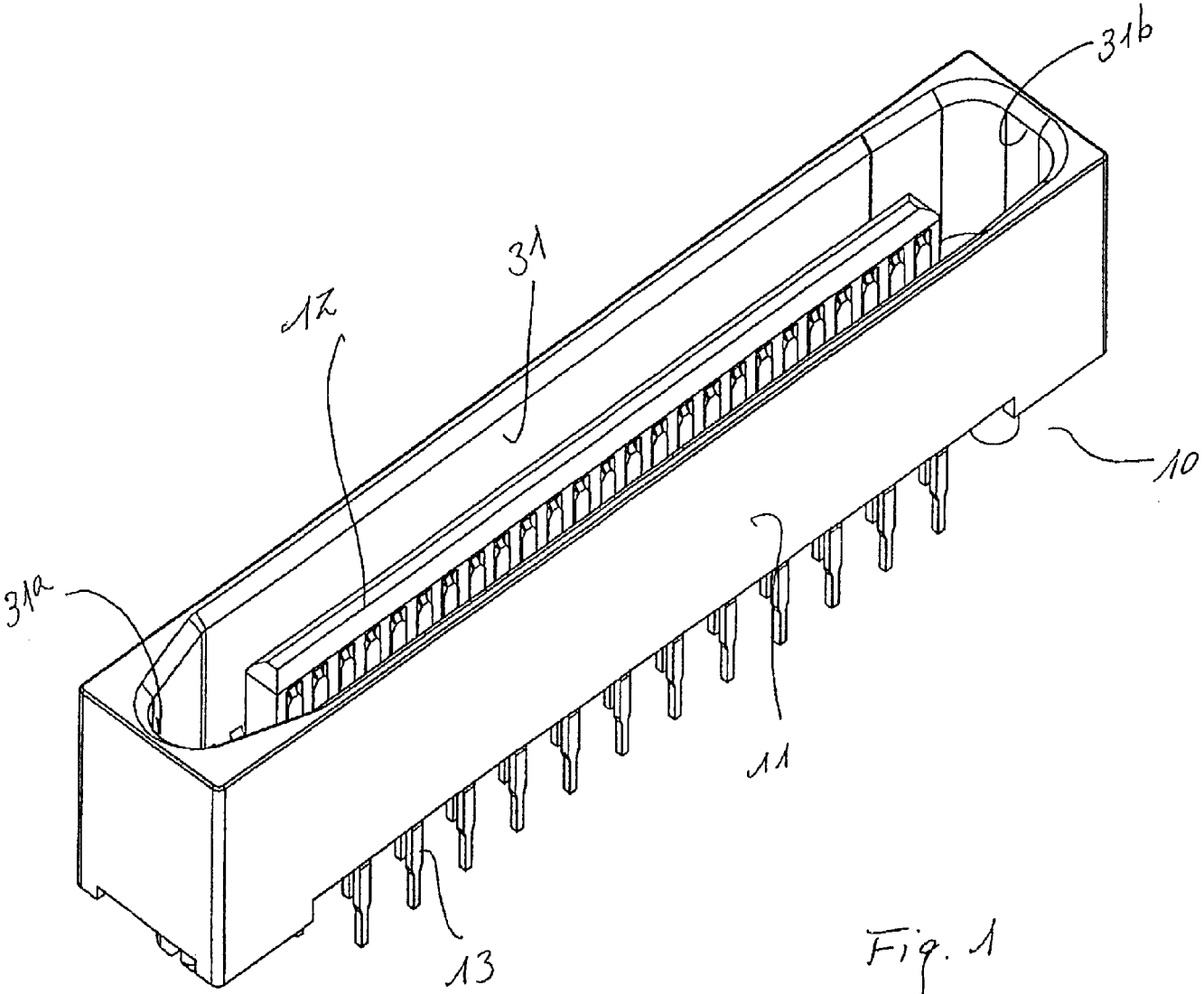
FIG. 1 is a perspective view of a male connector in which a polarizing receptacle is provided.
Figure 2:
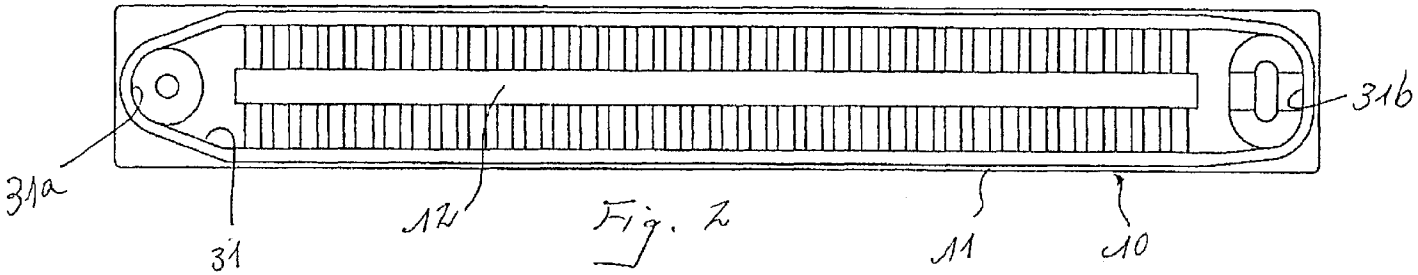
FIG. 2 is a top plan view of FIG. 1.
Figure 5:
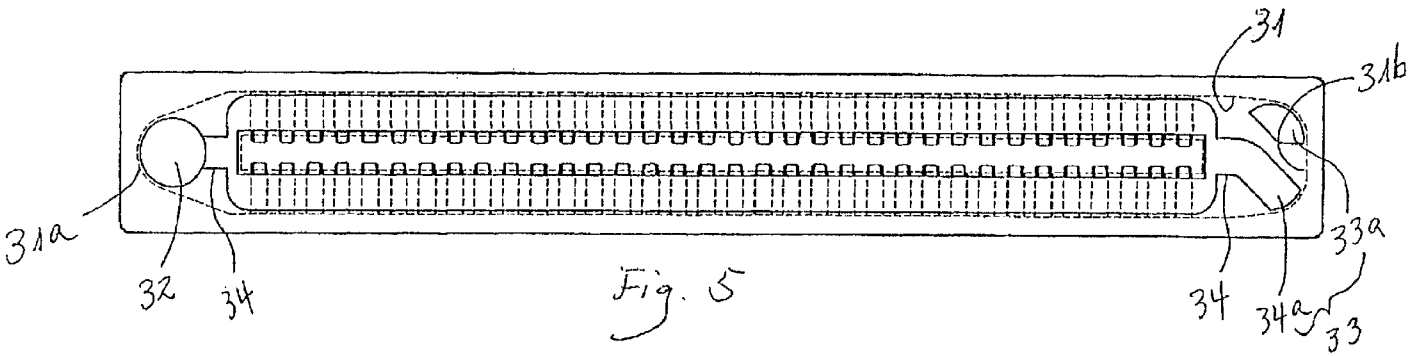
FIG. 5 is a sketch view showing the polarizing posts are smoothly received in the polarizing receptacle.
Figure 4:
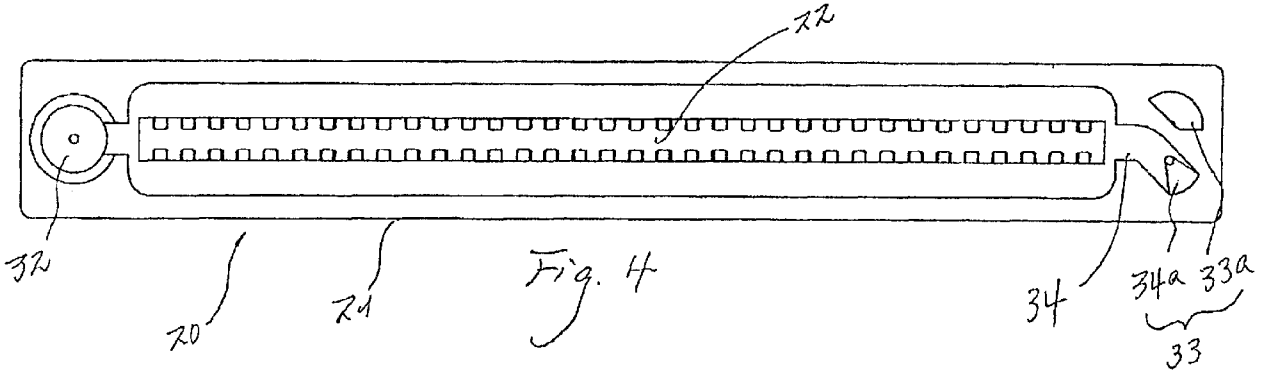
FIG. 4 is a top view of FIG. 3.
Figure 3:
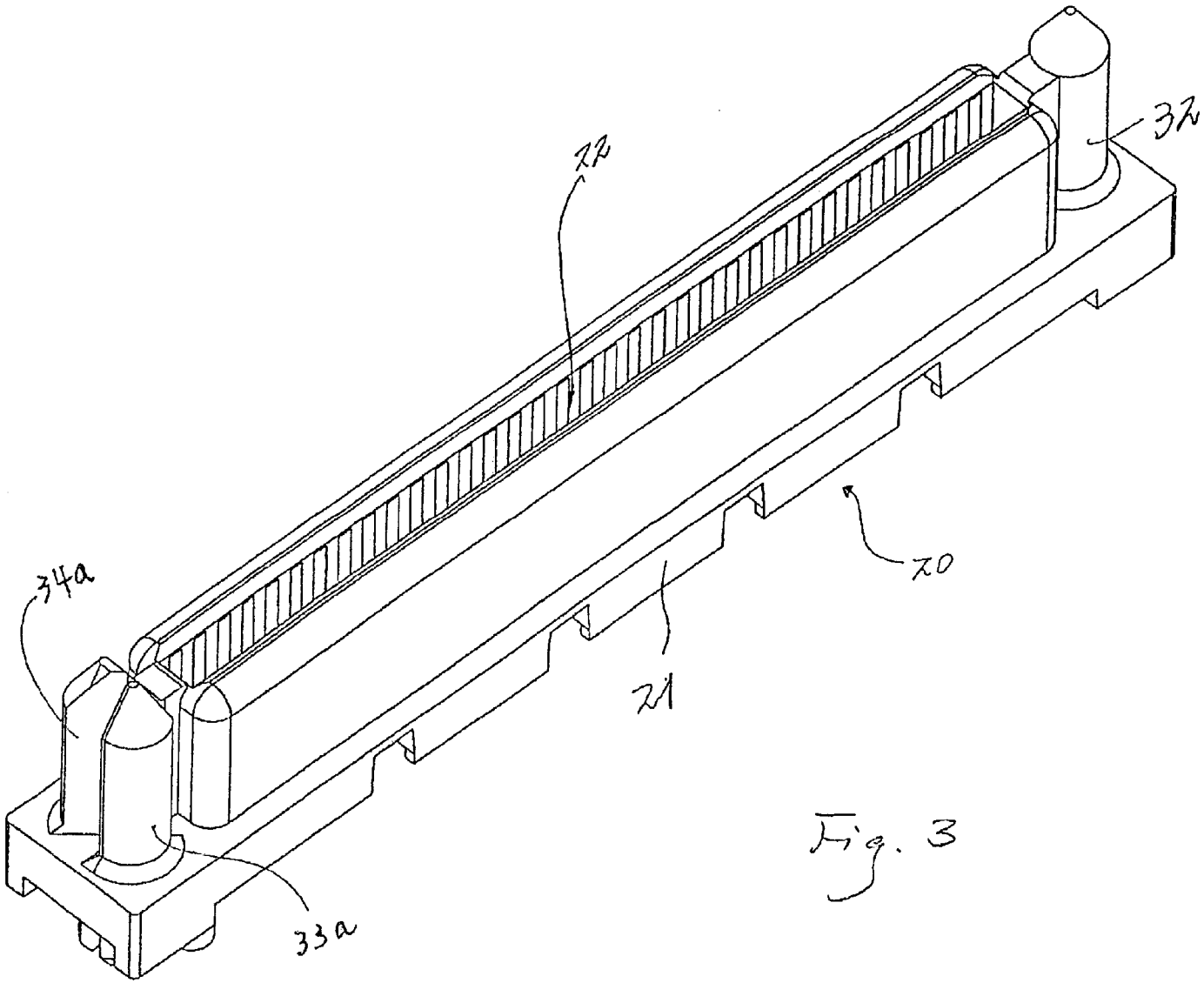
FIG. 3 is a perspective view of a female connector in which polarizing posts are provided.

Referring to FIGS. 1 to 5, a polarizing system for electrical connector assembly which includes male and female connectors 10, 20. The male and female connectors 10, 20 are each has a housing 11, 21 mateable with each other only when said polarizing system 30 functions correctly. The male connector 10 includes an island 12 in which a plurality of terminals is assembled (not shown). The female connector 20 includes an elongate slot 22 in which a plurality of terminals is assembled (not shown). When the male and female connectors 10, 20 are assembled, the island 12 is electrically received in the elongate slot 22.

The polarizing system 30 in accordance with the present invention generally includes an elongate polarizing receptacle 31 extending longitudinally along the male connector 10 such that the island 12 is arranged in the middle of the receptacle 31. The receptacle 31 includes first and second ends 31*a*, 31*b* each has different in curvature.

The polarizing system 30 further includes a pair of polarizing posts 32, 33 projecting on both ends of the female connector 20. The polarizing posts 32, 33 are arranged generally along a longitudinal axis of the female connector 20 and which are different from each other. According to the preferred embodiment, the first polarizing post 32 is a cylindrical post, when the second polarizing post 33 is a hybrid. As a matter of fact, the second polarizing post 33 is configured by an extension 34*a* of a rib 34 bridged between the female connector 20, and an offset post 33*a* spatially separated from said rib 34 and its associated extension 34*a*, wherein the space therebetween provides resiliency of each separate piece. The width of a combination of the extension 34*a* and the offset post 33*a* jointly define a width which is larger then a diameter of the first post 32.

As clearly shown in FIG. 1, the first end 31*a* of the receptacle is dimensioned to receive the first polarizing post 32, while the second end 31*b* of the receptacle 31 is dimensioned to receive the second polarizing post 33. It can be readily seen from FIG. 5 that the first end 31*a* of the receptacle 31 is too small to receive the second polarizing post 33.

One of the features of the polarizing system 30 is the first and second polarizing posts 32, 33 are not completely surrounded by the first and second ends 31*a*, 31*b* of the receptacle 31. By this arrangement, the polarizing system 30 made in accordance with the present invention can easily and smoothly mate with other polarizing system because no completely surrounding is required. As a result, connectors from different manufacturers can mate with the polarizing system 30.

For example, the female connector of the prior art can readily mate with the male connector 10 because the polarizing posts of prior art can easily mate with the ends 31*a*, 31*b* of the receptacle 31 defined in the male connector 10 without any problem. However, if the prior art polarizing posts are not correctly aligned with the corresponding polarizing ends, then it is unlikely to have a mate therebetween. As a result, the computer integrator may have more selections.

Figure 6:
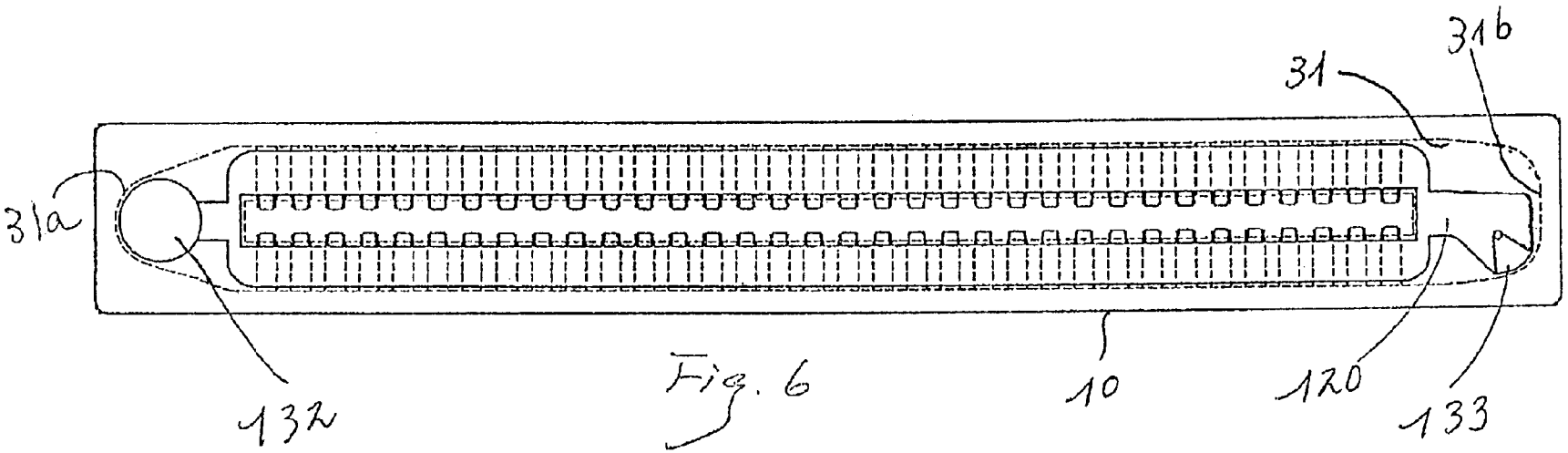
FIG. 6 is a sketch view showing the polarizing receptacle receives another type of polarizing posts.

FIG. 6 is an illustration of another embodiment in which a female connector 120 with asymmetrical polarizing posts 132, 133 is received in the polarizing receptacle 31.

While the present invention has been described with reference to specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A polarizing system for an electrical connector assembly which includes first and second connectors, said first and second connectors each having a housing mateable with each other only when said polarizing system functions correctly said polarizing system comprises:

a pair of polarizing posts projecting on either ends of said first housing, said polarizing posts being arranged generally along a longitudinal axis of the first housing and with one of said posts being different from the other post in shape; and an elongate polarizing receptacle extending longitudinally along said second connector with a first end dimensioned to receive said first post and a second end dimensioned to receive the second post;

wherein said polarizing posts are not substantially surrounded by said first and second ends of said elongate polarizing receptacle;

wherein said second post is configured by first and second pieces;

wherein said first piece is a rib extending from a protrusion of said first housing, and said second piece is an individual pin member adjacent to said rib.

2. The polarizing system as recited in claim 1, wherein said rib has an offset portion extending away from said individual pin member.

3. An electrical connector assembly comprising:

first and second connectors mateable with each other;

first and second receptacles formed around two opposite ends of said first connector, said first receptacle being larger than and unlike said second receptacle in configuration;

first and second guidable post devices formed around two opposite ends of said second connector; said first guidable post device being unlike the second guidable post device in configuration;

wherein said first guidable post device fits the first receptacle and it does not fit the second receptacle; said second guidable post device fits the second receptacle and does not fit the first receptacle;

wherein said first guidable post device includes two separate pieces with a space therebetween.

4. The assembly as recited in claim 3, wherein said second guidable post device is symmetrical with regard to a lengthwise central line of said second connector while said first guidable post device is not.

5. The assembly as recited in claim 3, wherein each of the first receptacle and the second receptacle is symmetrical with regard to a lengthwise central line of the first connector.

* * * * *